United States Patent [19]

Bensberg et al.

[11] 4,405,304

[45] Sep. 20, 1983

[54] ADJUSTABLE CARTON FOLDING MACHINE

[75] Inventors: Wolfgang Bensberg, Düsseldorf; Hartmut Klapp, Kaarst, both of Fed. Rep. of Germany

[73] Assignee: Jagenberg-Werke AG, Dusseldorf, Fed. Rep. of Germany

[21] Appl. No.: 270,432

[22] Filed: Jun. 4, 1981

[30] Foreign Application Priority Data

Jun. 6, 1980 [DE] Fed. Rep. of Germany ..... 3021442

[51] Int. Cl.[3] ..... B31B 1/74

[52] U.S. Cl. ..... 493/476; 493/473; 493/478

[58] Field of Search ..... 493/475, 476, 478; 83/345, 479, 480, 481, 508.1

[56] References Cited

U.S. PATENT DOCUMENTS 2,808,693 10/1957 Guggenheim ..... 493/476
3,503,293 3/1970 Sander ..... 83/481
4,212,218 7/1980 Braner et al. ..... 83/479
4,224,847 9/1980 Tokuno ..... 83/71
4,226,151 10/1980 Littley et al. ..... 83/479

FOREIGN PATENT DOCUMENTS 147067 3/1981 Fed. Rep. of Germany ..... 83/479

*Primary Examiner*—Nicholas P. Godici
*Assistant Examiner*—Kurt Rowan
*Attorney, Agent, or Firm*—Sprung, Horn, Kramer & Woods

[57] ABSTRACT

A folding-carton gluing machine comprising a machine frame, an inserter, conveying means for the flat carton blanks, a crossbeam on the frame, carton working tools slidably mounted on the crossbeam, means for adjusting the position of the tools relative to a blank, the tools being movable from a working position which they are to occupy in the machine into a position in which they are spaced from the working position, and a sliding table for a flat carton blank adapted to be moved under the tools when the latter are spaced from their working position.

8 Claims, 4 Drawing Figures

ADJUSTABLE CARTON FOLDING MACHINE

BACKGROUND OF THE INVENTION

The invention relates to a folding-carton gluing machine comprising a machine frame, an inserter, and conveying means for the flat carton blanks as well as tools such as ripping hooks, diagonal folders and the like which are slidably mounted on a crossbeam and act on the carton blank, are adjustable with respect to their position relative to the blank passing through the machine, and are adapted to be moved from the working position which they are to occupy in the machine into a position in which they are spaced from the working position.

When folding-carton blanks of different sizes are processed in a folding-carton gluing machine, the tools acting on the flat blank, such as ripping hooks, diagonal folders, etc., must be aligned so relative to the blank that they can be relied on to act in a satisfactory and trouble-free manner on blanks being run through the machine at high speed.

To align the tools with a particular carton blank, the latter has up to now been passed slowly from one working station in the machine to the next, and the proper settings have been made on the basis of the blank. This approach to setting up the tools is possible only when the machine is out of operation. In the case of standard folding cartons, setup amounts to 2 to 5 percent of the overall production time for a given number of blanks whereas with folded-bottom boxes it accounts for 30 to 50 percent. These setup times are a real factor when setting up can be done only with the machine shut down. Moreover, this setting-up technique permits coarse settings but not fine settings that would allow very rapid passage of the blanks through the machine, with trouble-free action of the tools on the blanks, without repeated adjustments.

A folding-carton gluing machine is also known in which tools which temporarily are not in use can be moved upward at an angle and thus out of the working area.

SUMMARY OF THE INVENTION

The object of the invention is to provide, by the use of simple structural means, a folding-carton gluing machine of the type outlined above wherein the tools can be rapidly and precisely aligned with a particular carton blank in such a way that trouble-free tool action on blanks moving through the machine at a very fast rate is secured while machine downtime is largely eliminated.

In accordance with the invention, this object is accomplished in that a sliding table which accommodates the flat carton blank is adapted to be moved under the tools, in the position in which they are spaced from the working position, and optionally at least one upper conveyor belt for the carton blanks, in the direction relative to the tools in which the carton blanks move through the machine relative to the tools when the latter are in their working position.

When pivoted out of the way, the tools are located in a plane that is parallel to the plane in which they are located in their working position, and the sliding table in accordance with the invention with the carton blank secured to it then assumes the function of the folding-carton gluing machine as such, that is to say, the blank can, as in the machine, be fed to the tools and folded by them. With a freely moving sliding table, the flat carton blank can thus be moved manually past the tools, and the person doing the setting up can then readily determine just how the tools act on the carton blank. From the ease or difficulty with which the blank moves past the tools, the person setting up is able to judge which is the best tool setup and the optimum tool action on the carton blank. This judgment cannot be developed when a blank is moved past the tools under machine power.

Besides, the tools to be set up can easily be watched by the operator and are readily accessible to him. The fine adjustment of the tools possible in accordance with the invention results in more satisfactory folding and a higher production rate.

A considerable advantage of the solution in accordance with the invention is that much time is saved in setting up. Especially when standard folding cartons are to be handled on a folding-carton gluing machine, 75 percent of the tools for processing folded-bottom boxes can be set up in accordance with the invention without production of the standard cartons having to be interrupted since those tools are not needed.

In an advantageous embodiment, the tools can be rotated about a vertical shaft disposed on one side of the machine. For this purpose, the crossbeam carrying the tools can be supported through a sliding sleeve on a shaft, with the sleeve either rotating about the fixed shaft or rotating with the shaft relative to the machine frame.

To prevent the other parts of the machine from interfering with the tools as they are being pivoted out of the way, the crossbeam carrying the tools is adapted to be raised along said vertical shaft either before or as it is being rotated thereabout and, optionally, to be again lowered in the end position. However, the pivoting table may be disposed above the lower conveyor belts, secured to the machine frame, for the flat blanks by an amount equal to that by which the crossbeam is raised. In that case, no lowering in the end position will be necessary.

With every pivotable working station equipped with tools, there may be associated a sliding table which may be adapted to be hinged to the machine, along with its guideways and bearings, in order to provide improved access to the machine after the tools have been swung back.

However, a single sliding table might instead be provided that is associated with all working stations equipped with tools and is displaceable along the side of the machine where the vertical shafts are located. For example, there may be provided along the side of the machine, and parallel to its longitudinal axis, guide rails on which the sliding table carrying a carton blank secured thereto can be moved in a direction parallel to the direction in which the carton blanks move through the machine, the spacing of said carton blank from the pivot shaft then being equal to the spacing of the carton blanks passing through the machine from the pivot shaft. These guide rails of the sliding table may likewise be hinged to the side of the machine so that after the tools have been set up the machine will be more accessible from that side.

The crossbeam carrying the tools can be rotated through an angle of either 90 degrees or 180 degrees. In particular, in connection with the displacement of the sliding table parallel to the direction in which the carton blanks move through the machine the crossbeam executes a 180-degree rotation. With 90-degree rotation, the sliding table is displaceable at right angles to the direction in which the carton blanks move through the machine.

In order that the tools may be in their exact lateral position after they have been swung back, a fixed mark is provided in the inserter and on the sliding table. The stack in the inserter and the carton blank on the sliding table are aligned with these marks.

Longitudinal and transverse positions may be set up completely without production being interrupted.

BRIEF DESCRIPTION OF THE DRAWINGS

Further details, characteristics and advantages of the invention will become apparent from the description which follows of the embodiments illustrated diagrammatically in the accompanying drawings, wherein.

DETAILED DESCRIPTION OF THE INVENTION

Figure 1:
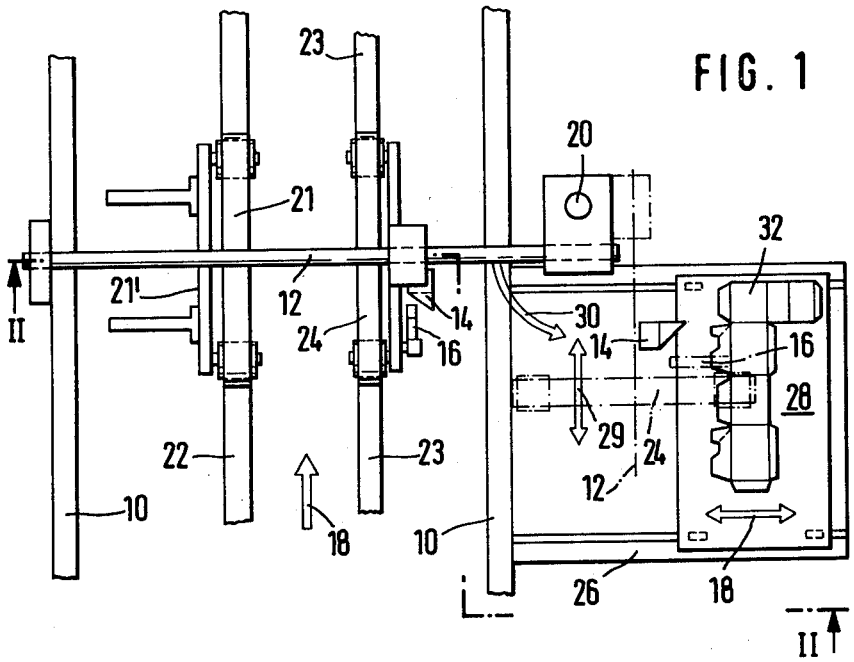
FIG. 1 is a top plan view of a portion of the length of a folding-carton gluing machine with one working station.

FIG. 1 shows diagrammatically a portion of the length of a folding-carton gluing machine with a machine frame 10. On a crossbeam 12 there are schematically indicated diagonal folders 14 and ripping hooks 16. These working tools act on the carton blanks as the latter pass through the machine in the direction of the arrow 18 in FIG. 1. To permit the various folding operations to be performed on the blank, the machine is provided with a plurality of these tool-equipped crossbeams in sequence which, however, are not shown.

Figure 2:
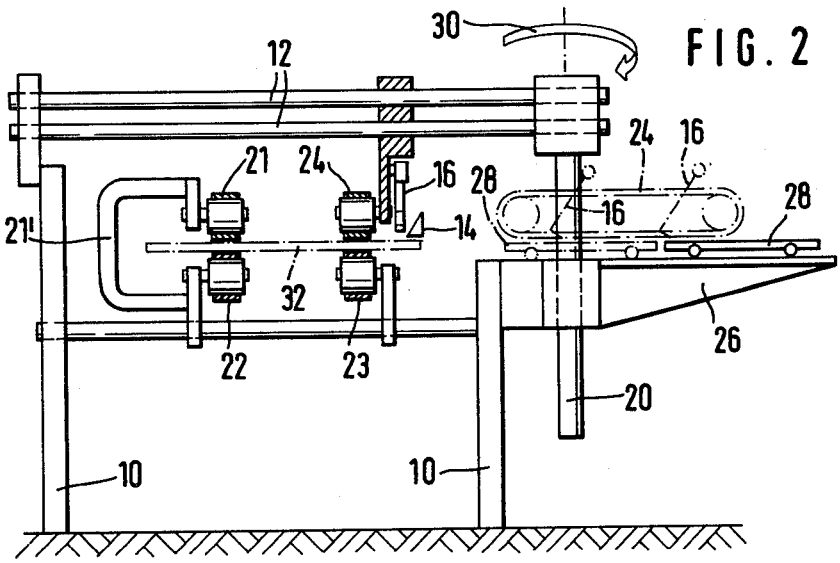
FIG. 2 is a cross-sectional view through the working station of FIG. 1, taken along the line II—II.

As is apparent from the drawings, the crossbeam is supported at one end in the machine frame. At the other end, the crossbeam can be rotated about a vertical pivot shaft 20 from the working position shown in FIG. 1 in solid lines into the setup position indicated in FIG. 1 by dashed lines. During this movement, a lower right-hand conveyor belt 23 remains stationary, as shown in FIG. 2. An upper left-hand conveyor belt 21 is coupled to a lower left-hand conveyor belt 22 through a bracket 21'. While these two conveyor belts are displaceable at right angles to the direction in which the carton blanks move through the machine, they remain in the working position in order that during the time that the folding tools for the folded-bottom boxes are set up the machine may continue to process standard folding cartons without having to be shut down. An upper right-hand conveyor belt pivots together with the cross-beam 12. According to FIG. 1, this upper conveyor belt is displaceable sideways in the direction of the double arrow 29, as indicated in the pivoted position.

The crossbeam 12 is not only rotatable about the vertical pivot shaft 20 but is also displaceable in the longitudinal direction of the latter, that is to say, vertically. Outside the machine frame, on the side where the pivot shaft 20 is located, there is disposed a support 26, which may optionally be hinged to the machine frame, for a sliding table 28 which is freely movable horizontally, as indicated by the arrow 18, on the support 26 at right angles to the direction in which the carton blanks move through the machine, and to which table a carton blank can be secured. The end positions of the sliding table 28 are indicated in FIG. 2 in solid and dash-dotted lines, respectively.

Such a sliding table may be associated with every working station. When the sliding table is displaceable in the manner shown at right angles to the direction in which the carton blanks move through the machine, the crossbeam 12 is rotated 90 degrees for setting up the tools. When there is associated with all working stations a sliding table which is moved into the various working positions parallel to the direction in which the carton blanks pass through the machine, the setting up of the tools may be done in that direction, the crossbeam 12 being rotated outwardly through an angle of 180 degrees, and the sliding table being spaced preferably the same distance from the pivot shaft 20 as the means for conveying the carton blank through the machine. However, this need not be done when the sliding table is provided with an appropriate mark for positioning the carton blank on the sliding table as desired. When but one sliding table is provided, however, it may also be displaceable at right angles to the direction in which the blanks move through the machine, in the manner shown, for the setting up of the tools.

When the top of the sliding table is higher than the level at which the carton blanks move through the machine, by an amount equal to the amount by which the crossbeam 12 is raised prior to being rotated, it will not be necessary to lower the crossbeam 12 with the tools in the pivoted position.

The tools are set up as follows:

All crossbeams carrying tools are rotated together 90 degrees in the direction of the arrow 30, as shown in FIG. 1, possibly after being first raised. The crossbeams are locked in that position. In that position, the tools and the sliding table 28 are readily accessible to the operator. A particular carton blank is then secured to the sliding table 28 in alignment with a fixed mark. The tools are then coarsely adjusted visually and on the basis of the operator's experience. The operator then makes a trial run by moving the sliding table 28, which takes the place of the stationary lower conveyor belts 22 and carries the carton blank, under the tools. Since this displacement of the sliding table is effected manually, the operator can tell whether the moving table meets undue resistance as the tools engage the blank. When that resistance is too high, the tools are appropriately adjusted until the blank moves smoothly and satisfactorily through the machine. The tools which have thus been precisely adjusted are then rotated along with the crossbeam through the appropriate angle back into the working position, indicated in the drawings in solid lines.

Even while the machine is in operation processing a given type of folding carton, this setup procedure is carried out on tools which are intended to be used with the next type of folding carton to be processed but are not needed for the current production run and therefore have been swung out of the working position.

The tools which have been set up are pivoted back into the working position when the machine, which during setup was working on an order for simple folding cartons, has completed that job and is turned off. In this way, most (about 75 percent) of the tools are set up in advance and only the remaining tools (about 25 percent) need to be set up while the machine is out of operation. The result is a 75 percent reduction in downtime.

Figure 4:
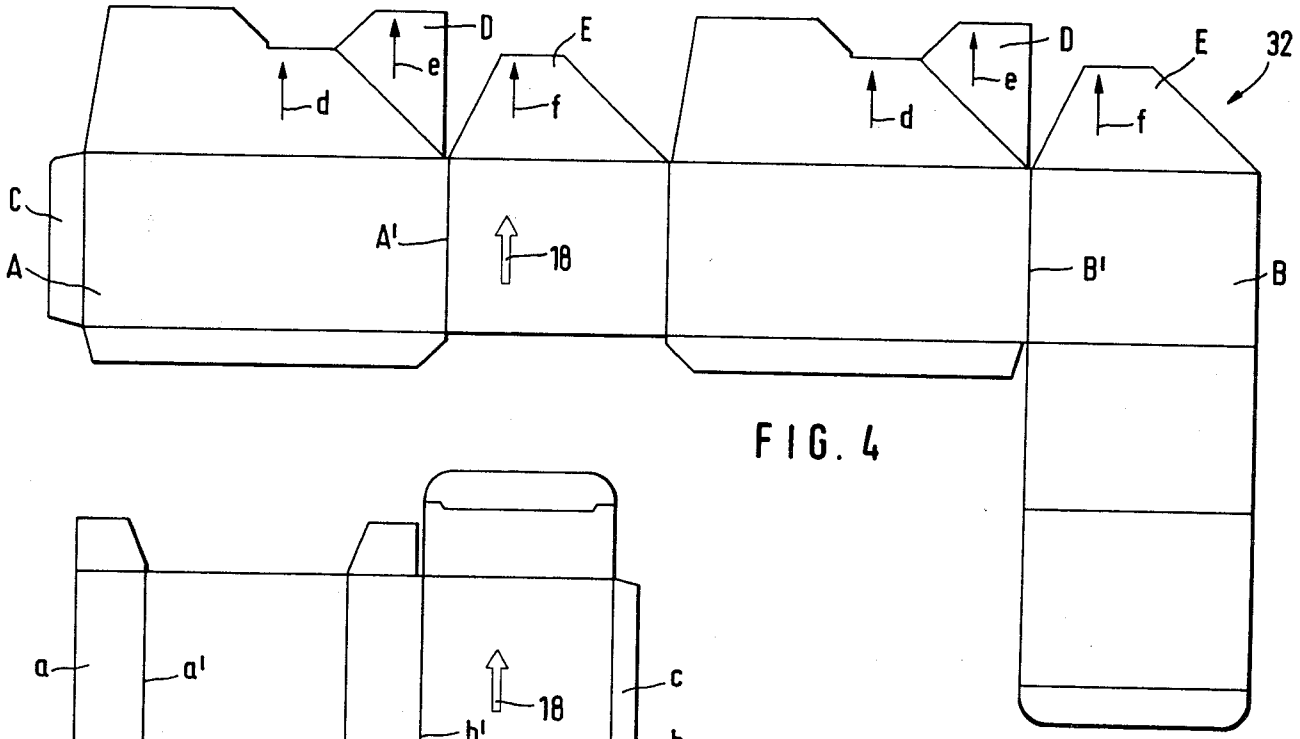
FIG. 4 is a top plan view of a flat blank for a folded-bottom box.
Figure 3:
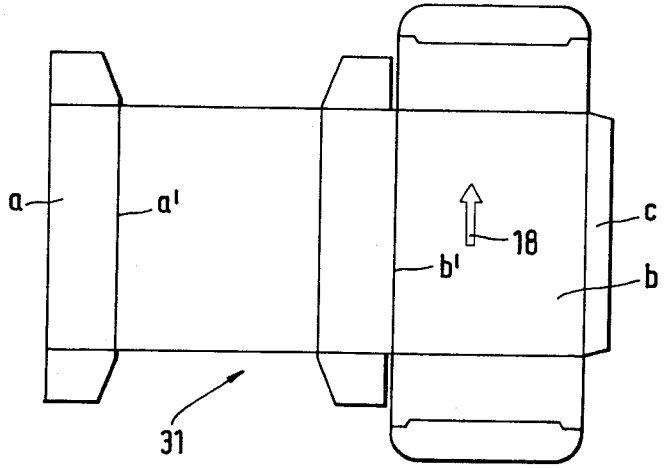
FIG. 3 is a top plan view of a flat blank for a standard folding carton.

The folded-bottom box blank 23 shown in FIG. 4 is moved through the machine and with the sliding table 28 in the direction of the arrow 18. (See also FIG. 1.) In the case of the standard folding-carton blank 31 illustrated in FIG. 3, the sections a and b are flipped inwardly in the machine along the scoring lines a′ and b′, and the sections a and b are then glued together. After appropriate repositioning, the tools employed for this purpose are used also with the blank 32 to flip the sections A and B inwardly along the scoring lines A′ and B′, respectively, following which the sections B and C are glued together. These tools must be adjusted while the machine is not in use.

In the case of the blank 32, folding hooks must be employed simultaneously at the points indicated by the arrows d and f, and diagonal folders at the points indicated by the arrows e, to flip the respective sections in the proper direction so that the sections D and E can be glued together. These tools can be pivoted out of the way and thus set up while the carton blanks 31 are being run through the machine.

It will be appreciated that the instant specification and claims are set forth by way of illustration and not of limitation, and that various modifications and changes may be made without departing from the spirit and scope of the present invention.

What is claimed is:

1. A folding-carton gluing machine comprising a machine frame, conveying means for the flat carton blanks, a crossbeam on the frame, carton working tools slidably mounted on the crossbeam, means for adjusting the position of the tools relative to a blank, the tools being movable from a working position which they are to occupy in the machine into a position in which they are spaced from the working position, and a sliding table for holding a flat carton blank and moving said blank under the tools when the latter are spaced from their working position to enable manual adjustment of said tools.

2. A machine according to claim 1, including at least one upper belt for conveying the carton blanks in the direction relative to the tools in which the carton blanks move through the machine relative to the tools when the latter are in their working positions.

3. A machine according to claim 1, wherein the tools are rotatable about a vertical shaft disposed on one side of the machine.

4. A machine according to claim 3, wherein the crossbeam carrying the tools is supported on said vertical shaft.

5. A machine according to claim 3, wherein the crossbeam carrying the tools is adapted to be raised along said vertical shaft either before or as it is being rotated thereabout and, optionally, to be again lowered in the end position.

6. A machine according to claim 1, including a pivotable working station and a sliding table associated with the working station.

7. A machine according to claim 1, wherein the crossbeam carrying the tools is rotatable through an angle of 90 degrees.

8. A machine according to claim 1, wherein the crossbeam carrying the tools is rotatable through an angle of 180 degrees.

* * * * *